United States Patent [19]

Ohashi

[11] 4,065,043

[45] Dec. 27, 1977

[54] ROTARY SPEED MINUTE REGULATING DEVICE FOR OUTPUT SHAFT IN PULLER APPARATUS

[76] Inventor: Katsuji Ohashi, 28-2, 1-chome, Yawataya, Osaka, Japan

[21] Appl. No.: 679,314

[22] Filed: Apr. 23, 1976

[30] Foreign Application Priority Data

Apr. 23, 1975 Japan ..... 50-49991

[51] Int. Cl.[2] ..... B65H 17/22

[52] U.S. Cl. ..... 226/141; 74/117; 112/211; 226/156

[58] Field of Search ..... 112/203, 205, 208, 209, 112/211, 210, 47; 226/120, 137, 141, 156 X, 158; 74/21, 24, 84 R, 117

[56] References Cited

U.S. PATENT DOCUMENTS

| | | | |
|---|---|---|---|
| 1,496,816 | 6/1924 | McNeil | 112/203 |
| 2,687,704 | 8/1954 | Galkin | 112/211 |
| 2,713,837 | 7/1955 | Rabinowitz | 112/211 X |
| 3,076,368 | 2/1963 | Groll | 226/156 X |
| 3,357,384 | 12/1967 | Washburn | 112/209 |
| 3,450,079 | 6/1969 | Lukin | 112/209 |
| 3,468,272 | 9/1969 | Shimobayashi | 112/211 X |
| 3,611,817 | 10/1971 | Smith et al. | 112/209 |
| 3,985,088 | 10/1976 | Sugahara | 112/209 X |

*Primary Examiner*—Werner H. Schroeder
*Assistant Examiner*—Moshe I. Cohen
*Attorney, Agent, or Firm*—Larson, Taylor and Hinds

[57] ABSTRACT

For use with a sewing machine, a cloth pulling apparatus has a rotatable input shaft for coupling to a rotary drive force, and a pair of output shafts provided with cloth-pulling rotors mounted so as to feed cloth through a nip between the rotors. A variable transmission means converts the rotary movement of the input shaft to intermittent unidirectional opposite rotation of the cloth-pulling rotors. The transmission means comprises an eccentric rod pivotally mounted at one of its ends on the input shaft such that rotation of the input shaft effects oscillation of the other end of the rod. A one-way drive member is coupled to the output shafts such that oscillatory movement of the one-way drive member effects intermittent unidirectonal opposite rotation of the output shafts. A linkage effects oscillatory movement of the one-way drive member in accordance with oscillation of the oscillatory end of the eccentric rod, and this linkage is provided with adjustable means coupled to the eccentric rod for determining and varying the osicllatory path of the oscillatory end of the rod. Manually actuatable means are accessible from the exterior of the casing of the apparatus for adjusting the adjustable means so as to adjustably set the oscillatory path of the oscillatory end of the eccentric rod, and hence the oscillatory movement of the one-way drive member. The apparatus thus provides for precise control and variation of the movement of the cloth-pulling rotors from the exterior of the casing in a very simple and convenient manner.

7 Claims, 3 Drawing Figures

ROTARY SPEED MINUTE REGULATING DEVICE FOR OUTPUT SHAFT IN PULLER APPARATUS

FIELD OF THE INVENTION

This invention relates to an improvement in rotary speed regulating devices for output shafts of cloth-pulling rollers in puller apparatus provided to pull cloth toward its feeding direction in co-operation with cloth-feeding mechanism of industrial sewing machines etc. (When this puller apparatus is provided at the feeding side of cloth, it is utilized as a so-called feeder device for cloth.)

BACKGROUND OF THE INVENTION

Rotary speed of said output shafts must be properly increased or decreased corresponding to the cloth material, but in customary speed regulating devices, rotary speed of the output shafts has been varied by transferring the pivot part at one end of an eccentric rod, pivoted movably in a diametric direction of the input shaft, to a desirable radial distance, and fixing at that position; hence in the case of said regulation, such operation as loosening and retightening of fixing bolts etc. of the pivot part at one end of said rod must be performed. Accordingly this regulating operation has been a troublesome matter and inefficient operation, since the transmitting mechanism such as the eccentric rod is received ordinarily within a main body case.

In the illustrated and preferred embodiment of this invention, a rotatable adjustment member carries a worm meshed with a shaft-mounted worm wheel, and a linkage connects the worm wheel shaft, the end of an eccentric rod, and the operating member of a unidirectional clutch, such that the rotary speed of output shafts carrying the cloth-pulling rollers can be regulated precisely during operation merely by turning the adjustment member.

DESCRIPTION OF THE PREFERRED EMBODIMENT

Figure 1:
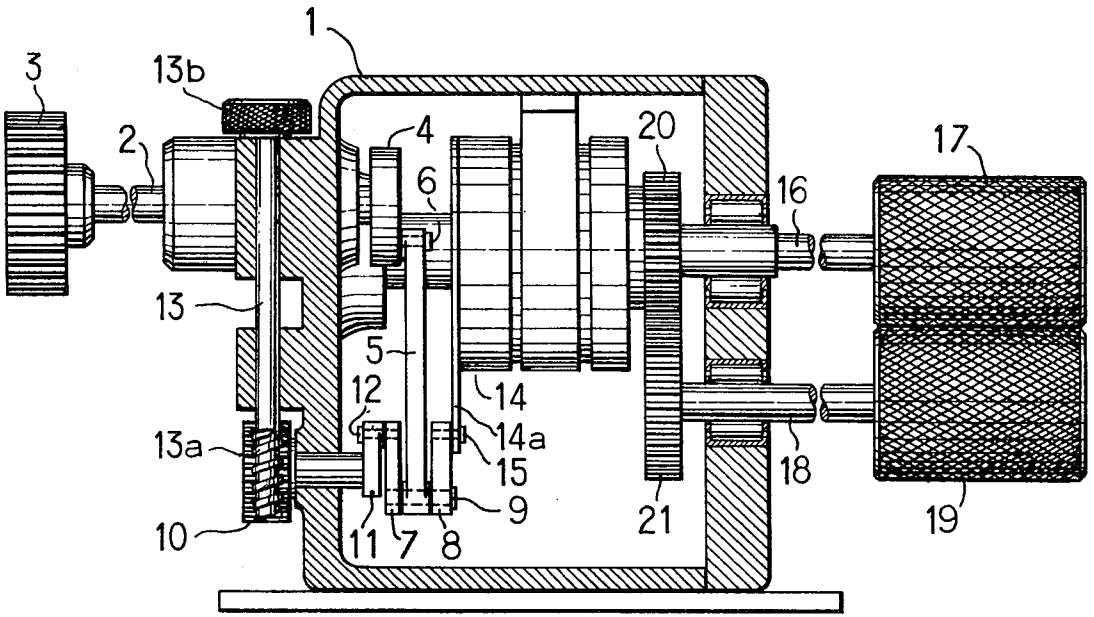
FIG. 1 is a front elevational view, partially in section, of a puller device in accordance with a preferred embodiment of this invention.

This device will be explained referring to one practical embodiment shown in the drawings as follows. In the drawings, 1 is the main body case of puller apparatus, 2 is an input shaft bearing-supported properly on said case, and is located outside the case. Follower gear 3 is secured to one end of said input shaft, and it is constituted so that input shaft 2 is rotated in co-operation with cloth-feeding mechanism of a sewing machine (not shown) when power at the sewing machine side is transmitted to said gear through a timing belt etc. reference 4 designates flange secured to another end of input shaft 2 located within the case, and one end of eccentric rod 5 is pivoted on this flange by pin 6, and one end of each of links 7 and 8 is pivoted respectively at the other end of said rod by pin 9. Gear 10 is a worm wheel properly bearing-supported on case 1, and arm 11 is secured to one end of the rotary shaft of this gear located inside the case. One end of this arm and another end of said link 7 are connected together by pin 12, and gear 10 is meshed with worm 13*a* of adjustment member 13 provided rotatively on case 1. Head part 13*b* of this member is supported at a proper place exterior of case 1. Device 14 is a one-directional clutch or drive supported by case 1, and operating piece 14*a* of this clutch and another end of link 8 are pivoted together by pin 15. Shaft 16 is an output shaft provided so as to rotate only toward one direction by said clutch, and this output shaft is properly bearing supported on case 1, and cloth-pulling roller 17 is secured to the shaft end located exterior of the case. References 18 and 19 denote another output shaft and roller respectively provided in opposed relation to said output shaft 16 and roller 17, and these constitute a so-called cloth-pulling mechanism i.e., when these rollers are rotated in reverse directions by driving gear 20 fitted onto said output shaft 16 and driven gear 21 provided on another output shaft 18 to be meshed with said driving gear 20, cloth to be inserted between said rollers 17, 19 is transferred forcedly toward one side.

In the construction as mentioned above, operation of the device according to this invention will be explained first referring to FIG. 2. When flange 4 is rotated in the direction of arrow (A) by rotation transmitted to input shaft 2, and the pivot part of eccentric rod 5 at this flange side is rotated by a 180° angle, the other end of this rod is turned to a position shown with chain line in the drawing by turning of link 7 around pin 12, secured by arm 11 located by gear 10, and at this time operating piece 14*a* of clutch is pulled by link 8, as the result output shaft 16 is turned by $\theta$ angle in the direction of arrow (A'). Then, when the pivot part of rod 5 at the side of flange 4 is rotated in the direction of arrow (A'') and returned to the original state shown with full line, operating piece 14*a* is turned in the reverse direction of arrow (A'), but turning of this operating piece can not rotate output shaft 16 in either direction since clutch 14 is a one-directional clutch.

Namely, only rotation of a 180° angle in the direction of arrow (A) is transmitted from input shaft 2 as the power to rotate output shaft 16.

Figure 2:
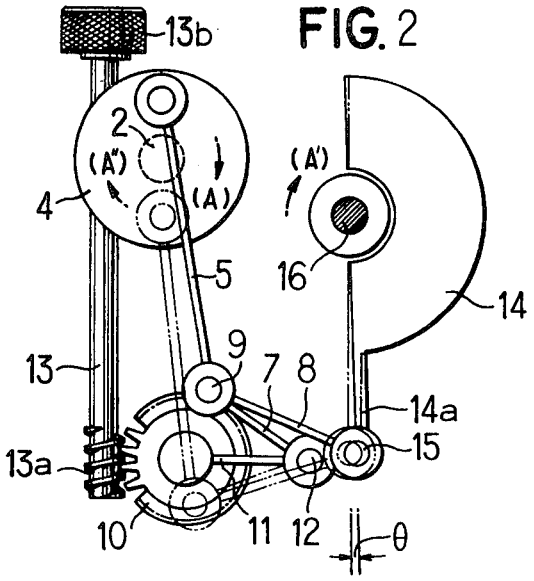
FIGS. 2 and 3 are schematic drawings illustrating operation of the device of FIG. 1.
Figure 3:
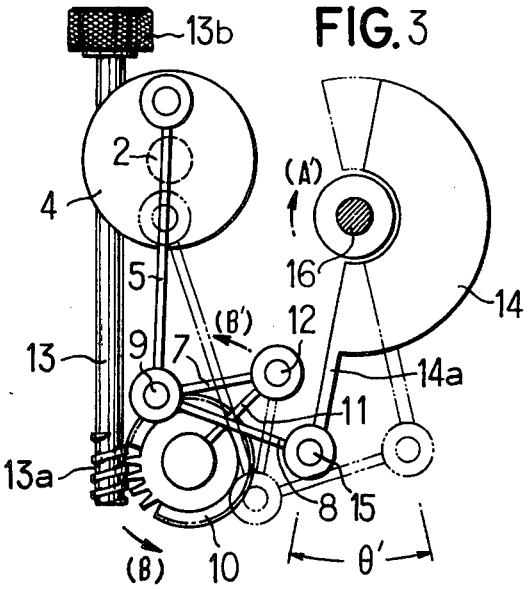

Next, when a larger rotary angle than that shown in FIG. 2 is required, gear 10 is turned in the direction of arrow (B) by turning adjustment member 13 as shown in FIG. 3, and pin 12 is turned in the direction of arrow (B') by its arm 11. In this state, when input shaft 2 is rotated similarly to the case mentioned above, operating piece 14*a* of clutch is once turned to the position shown with chain line, then output shaft 16 is rotated by $\theta'$ angle in the direction of arrow (A').

As the main point, rotation of input shaft 2 is transmitted intermittently and variably to output shaft 16 by turning screw frame 13 to position pin 12 properly and by limiting the turning range of eccentric rod 5 and links 7, 8.

As mentioned above, in this invention, in a construction comprising an input shaft having a follower gear and one pair of output shafts provided with cloth-pulling rollers constituted so as to transmit rotation of said input shaft to the cloth-pulling mechanism through an intermittent power transmitting mechanism consisting of an eccentric rod and one-directional clutch, the rotary speed regulating or adjusting member of said output shaft is provided rotatively on the main body case etc., and the adjusting member is meshed with a worm wheel provided also rotatively, and the rotary shaft of said worm wheel and one end of said eccentric rod, and this one end of this eccentric rod and the operating piece of said one-directional clutch, are connected turnably respectively through an appropriate linkage. Hence, according to such a device as this invention, not only rotary speed of the output shaft can be minutely regulated properly by such a simple operation as turning the adjustment member, but also it exhibits such effects that handling is very easy and operation is practical since in this device, there is no need to loosen and retighten bolts etc. each time to secure the pivot part of the input shaft at the end of the eccentric rod in the case of this regulation, and labor to intercept transmission of power to the end of the input shaft during each operation can be omitted.

What is claimed is:

1. For use with a sewing machine, a cloth pulling apparatus comprising a casing, a rotatable input shaft carried by said casing and adapted for coupling to a rotary drive source, a pair of output shafts carried by said casing and provided with cloth-pulling rotors mounted so as to feed cloth through a nip between rotors when rotated in opposite directions, and variable transmission means within the casing for converting rotary movement of said input shaft to intermittent unidirectional rotation of at least one of said output shafts and cloth-pulling rotors, said transmission means comprising a rod carried eccentrically and pivotally at one of its ends by said input shaft such that rotation of said input shaft effects oscillation of the other end of said rod, a one-way drive member coupled to said output shafts such that oscillatory movement of said one-way drive member effects intermittent unidirectional but respectively opposite rotation of said output shafts, means for effecting oscillatory movement of said one-way drive member in accordance with oscillation of said other end of said rod, adjustable means coupled to said eccentric rod for determining and varying the oscillatory path of said other end of said rod, and manually actuatable means accessible on the exterior of said casing for adjusting said adjustable means so as to adjustably set the oscillating path of said other end of said rod and hence the oscillatory movement of said one-way drive member, said adjustable means comprising a first link mounted for pivotal movement about an adjustably movable center and coupled to said rod such that pivotal movement of said first link about its center determines the oscillatory path followed by said other end of said rod, and said manually actuatable means comprising an adjustment member extending from the exterior of said casing and coupled with said adjustably movable center for determining and varying the location of said adjustably movable center within said casing.

2. Apparatus as claimed in claim 1 further comprising a rotatable adjustment gear carried by said housing, said adjustably movable pivot center being coupled to said adjustment gear so as to move in an arcuate path upon rotation of said gear such that the location of said center is determined by the angular setting of said adjustment gear, said adjustment member being a rotatable member coupled to said adjustment gear for variably setting the angular setting of said adjustment gear and hence the location of said adjustably movable pivot center.

3. Apparatus as claimed in claim 2 wherein said first link is pivotally coupled at one end to said adjustably movable center and at its other end to said other end of said rod, and said means for effecting oscillatory movement of said one-way drive member comprises a second link pivotally coupled at one end to said other end of said rod and at its other end to said one-way drive member so as to oscillate said drive member through an arc dependent upon the oscillatory path followed by said other end of said rod.

4. Apparatus as claimed in claim 3 wherein said adjustment member includes a worm threadedly engaged with said adjustment gear, said adjustment gear comprising a worm gear whose center or rotation corresponds to the rotational center of the arcuate path travelled by said adjustably movable pivot center.

5. Apparatus as claimed in claim 4 wherein said adjustably movable pivot center is coupled to said worm gear through a link so as to rotate with said worm gear.

6. For use with a sewing machine, a cloth pulling apparatus comprising a casing, a rotatable input shaft carried by said casing and adapted for coupling to a rotary drive source, a pair of output shafts carried by said casing and provided with cloth-pulling rotors mounted so as to feed cloth through a nip between the rotors when rotated in opposite directions, and variable transmission means within the casing for converting rotary movement of said input shaft to intermittent unindirectional but respectively opposite rotation of said output shafts and cloth-pulling rotors, said transmission means comprising oscillatory means oscillatably driven in response to rotation of said input shaft, unidirectional drive means responsive to oscillation of said oscillatory means for unidirectionally rotating said output shafts intermittently in respectively opposite directions over arcs dependent upon the oscillatory path traversed by said oscillatory means, adjustable means for determining and varying the oscillatory path of said oscillatory means, and manually actuatable means accessible on the exterior of said casing for adjusting said adjustable means so as to adjustably set the oscillatory path of said oscillatory means and hence the intermittent unidirectional rotation of said output shafts, wherein said adjustable means comprises a link pivotally coupled at one end to said oscillatory means and pivotally coupled at its other end to a pivot center such that the oscillatory path of said oscillatory means is an arcuate path about said pivot center, and means for selectively moving said pivot center along an arcuate path.

7. Apparatus as claimed in claim 6 wherein said adjustable means further comprises a worm and worm gear, said worm being coupled to said manually actuatable means, and means coupling said pivot center to said worm gear for movement with said worm gear about the rotational center of said worm gear in response to manual actuation of said actuatable means.

* * * * *